US006550294B2

(12) United States Patent
Garguilo

(10) Patent No.: US 6,550,294 B2
(45) Date of Patent: Apr. 22, 2003

(54) MANHOLE SECURITY DEVICE

(76) Inventor: Albert Garguilo, 610A Merrick Rd., Lynbrook, NY (US) 11563

( * ) Notice: Subject to any disclaimer, the term of this patent is extended or adjusted under 35 U.S.C. 154(b) by 0 days.

(21) Appl. No.: 09/833,469

(22) Filed: Apr. 12, 2001

(65) Prior Publication Data

US 2002/0148260 A1 Oct. 17, 2002

(51) Int. Cl.[7] ..... B65D 55/14; E05C 1/06; E05C 1/12; E02D 29/14

(52) U.S. Cl. ..... 70/168; 70/172; 292/33; 292/39; 292/155; 404/25

(58) Field of Search ..... 70/166, 167, 168, 70/169, 170, 171, 172, 173; 292/4, 32, 33, 35, 36, 41, 39, 160, 172, 155, 256.73, 256.71, 256.5, 260; 232/44; 404/25, 26; 74/89.13, 89.23, 89.28, 417

(56) References Cited

U.S. PATENT DOCUMENTS 257,743 A * 5/1882 Murray ..... 49/57
2,025,839 A * 12/1935 Woods, Jr. ..... 404/25
3,470,765 A * 10/1969 Campbell ..... 244/17.23
4,111,066 A * 9/1978 Kendrick ..... 74/417
4,228,656 A * 10/1980 Frosch et al. ..... 60/518
4,964,755 A * 10/1990 Lewis et al. ..... 292/336.3
5,082,392 A * 1/1992 Marchese et al. ..... 404/25
5,328,291 A * 7/1994 Wisniewski ..... 404/2
5,611,508 A * 3/1997 Palmero ..... 248/123.2
5,683,122 A * 11/1997 Lee ..... 292/172
5,685,510 A * 11/1997 Frankish ..... 108/147

* cited by examiner

*Primary Examiner*—Anthony Knight
*Assistant Examiner*—Michael J. Kyle
(74) *Attorney, Agent, or Firm*—Michael I Kroll

(57) ABSTRACT

The present invention 10 discloses a disk-like member 15 that would be placed on the cover-retaining flange 20 in the manhole tube 22 on which the cover 16 would ordinarily rest. The operator would then insert a turnkey 24 through a central recess 26 in the manhole security device 10 until it matched up with its corresponding mate on the underside of the plate and then rotate the turnkey, thereby extending two locking members 46 in opposing directions until their tips 33 are imbedded in the soft metal of the manhole ring 18. The extended, imbedded locking members 46 below the cover retaining flange 20 prevent the manhole security device from being removed until the proper mating turnkey 24 is inserted and the locking members 46 are retracted. The manhole cover 16 is placed over the locked manhole security device 10 until such time that authorized removal is desired.

6 Claims, 9 Drawing Sheets

MANHOLE SECURITY DEVICE

BACKGROUND OF THE INVENTION

1. Field of the Invention

The present invention relates generally to manhole covers, and more specifically, to a manhole security device that prevents access into a manhole by terrorists, vandals or any other unauthorized personnel not having a properly coded access key. Security needs have increased dramatically in recent years and manholes have been used by terrorists to plant bombs in highly trafficked or high profile areas such as parade routes often necessitating the welding shut of manhole covers to prevent the manhole from being breached. Welding the manhole covers shut is time-consuming and deters authorized personnel from doing their job in a quick and efficient manner. The present invention addresses the problem of manhole security by providing a plate that would be placed on the cover-retaining flange in the manhole on which the cover would ordinarily rest. The operator would then insert a coded turnkey through a central recess in the manhole security device until it matched up with it's corresponding mate on the underside of the plate and then rotate the turnkey thereby extending two locking members in opposing directions until their points are imbedded in the soft metal of the manhole ring. The extended, imbedded locking members below the cover retaining flange prevent the manhole security device from being removed until the properly coded turnkey is inserted and the locking members are retracted. The manhole cover is placed over the locked manhole security device until such time that authorized removal is desired.

2. Description of the Prior Art

There are numerous manhole cover devices, while these devices may be suitable for the purposes for which they were designed, they would not be as suitable for the purposes of the present invention as hereinafter described.

SUMMARY OF THE PRESENT INVENTION

The present invention discloses a plate-like member that would be placed on the cover-retaining flange in the manhole on which the manhole cover would ordinarily rest. The operator would then insert a turnkey through a central recess in the manhole security device until it matched up with its corresponding mate on the underside of the plate and then rotate the turnkey, thereby extending two locking members in opposing directions until their points are imbedded in the soft metal of the manhole ring. The extended, imbedded locking members below the cover retaining flange prevent the manhole security device from being removed until the proper mating turnkey is inserted and the locking members are retracted. The manhole cover is placed over the locked manhole security device until such time that authorized removal is desired.

A primary object of the present invention is to provide a manhole security device that will deny access to unauthorized personnel to the inside of a manhole in which the present invention is deployed.

An additional object of the present invention is to provide a manhole security device that will provide quick and easy access into the manhole by authorized personnel.

A further object of the present invention is to provide a manhole security device wherein the configuration of the male and female interlocking key components can vary to provide additional security.

A yet further object of the present invention is to provide a manhole security device utilizing a double bevel gear mechanism to rotate two opposing shafts to extend the locking members into the manhole ring.

Another object of the present invention is to provide a manhole security device wherein the locking members have a substantially cylindrical body with a first female threaded end and a second sharp, tapered end and further having an anti-rotational flange extending longitudinally from said body.

Still another object of the present invention is to provide a manhole security device wherein each locking member has a corresponding bracket with a keyway through which the locking member passes as the rotatable shaft is threaded or unthreaded thereby retracting or extending said locking member which slides therethrough without rotating due to the anti-rotational flange and the keyway.

Yet another object of the present invention is to provide a manhole security device that is simple and easy to use.

Yet another object of the present invention is to provide a manhole security device that is economical in cost to manufacture.

Further objects of the present invention will appear as the description proceeds.

To the accomplishments of the above and related objects, this invention may be embodied in the form illustrated in the accompanying drawings, attention being called to the fact, however, that the drawings are illustrative only, and that changes may be made in the specific construction illustrated and described in the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
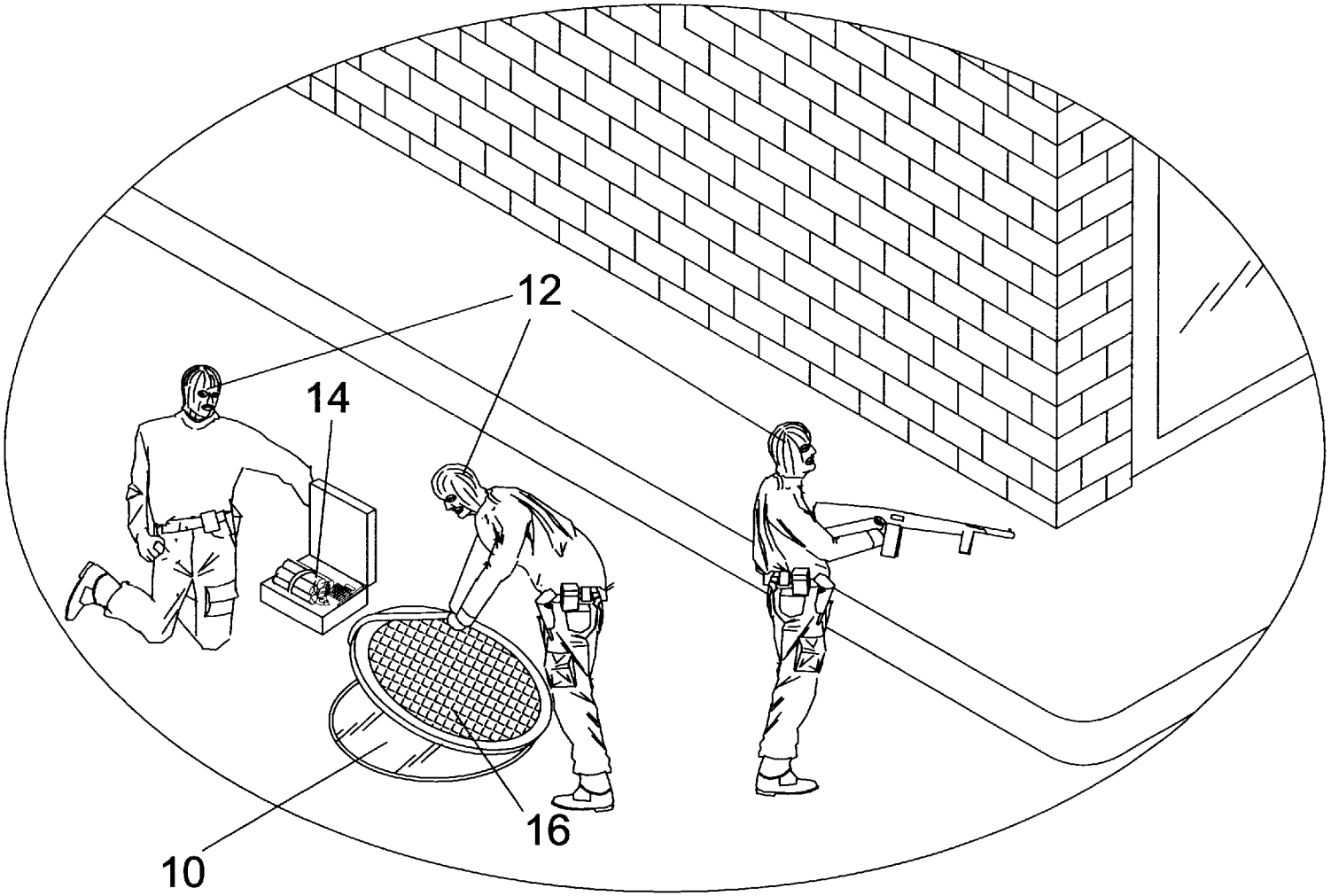
FIG. 1 is a perspective view of the present invention in use.

With regard to reference numerals used, the following numbering is used throughout the drawings.

10 present invention

12 terrorist
14 bomb
15 plate
16 manhole cover
18 manhole ring
20 retaining flange
22 manhole tube
24 turnkey
26 turnkey access recess
28 drive gear
30 rotatable shaft
31 ground
32 locking member
33 tip of locking member
34 keyway bracket
36 bevel gear assembly
38 flange of locking member
40 male threads
42 direction arrow
44 keyway aperture
46 male locking member
48 bracket
50 female threads
52 male locking member
54 turnkey female interlocking member
56 turnkey female interlocking member

DETAILED DESCRIPTION OF THE PREFERRED EMBODIMENTS

The following discussion describes in detail one embodiment of the invention and several variations of that embodiment. This discussion should not be construed, however, as limiting the invention to those particular embodiments, practitioners skilled in the art will recognize numerous other embodiments as well. For definition of the complete scope of the invention, the reader is directed to appended claims.

Turning to FIG. 1, shown therein is a perspective view of the top side of the disk-shaped present invention 10 in use showing terrorists 12 trying to plant a bomb 14 by removing a manhole cover 16 in a manhole and being deterred by the manhole security device 10 which prevents access by terrorists, vandals or any other unauthorized personnel not having a properly coded turnkey.

Figure 2:
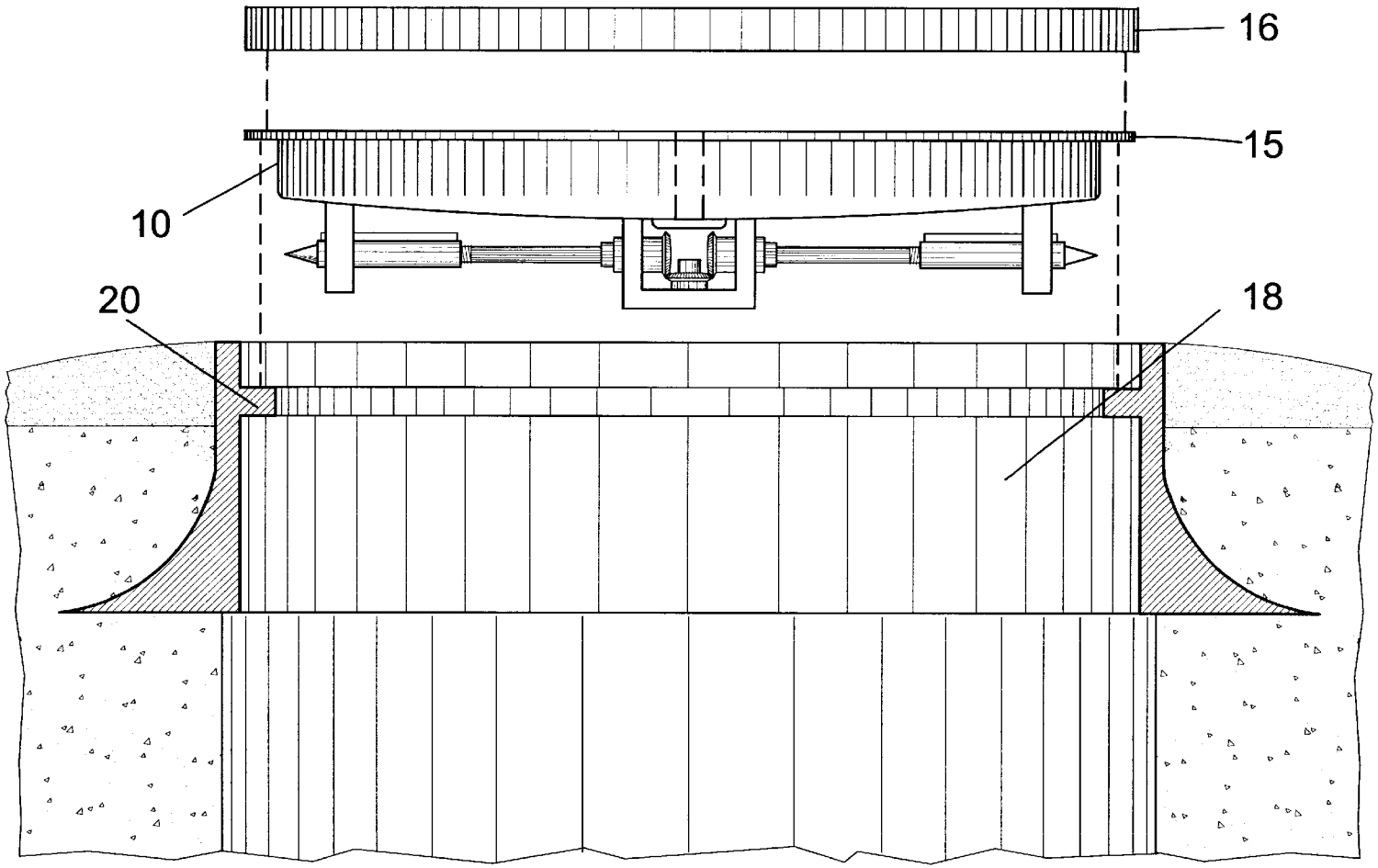
FIG. 2 is an exploded cross-sectional front view of the manhole components and the present invention.

Turning to FIG. 2, shown therein is an exploded front view of the present invention and the manhole components. Shown are the disk-shaped present invention 10, manhole cover 16, manhole ring 18, retaining flange 20 of the retaining ring along with the plate-like 15 top member of the present invention.

Figure 3:
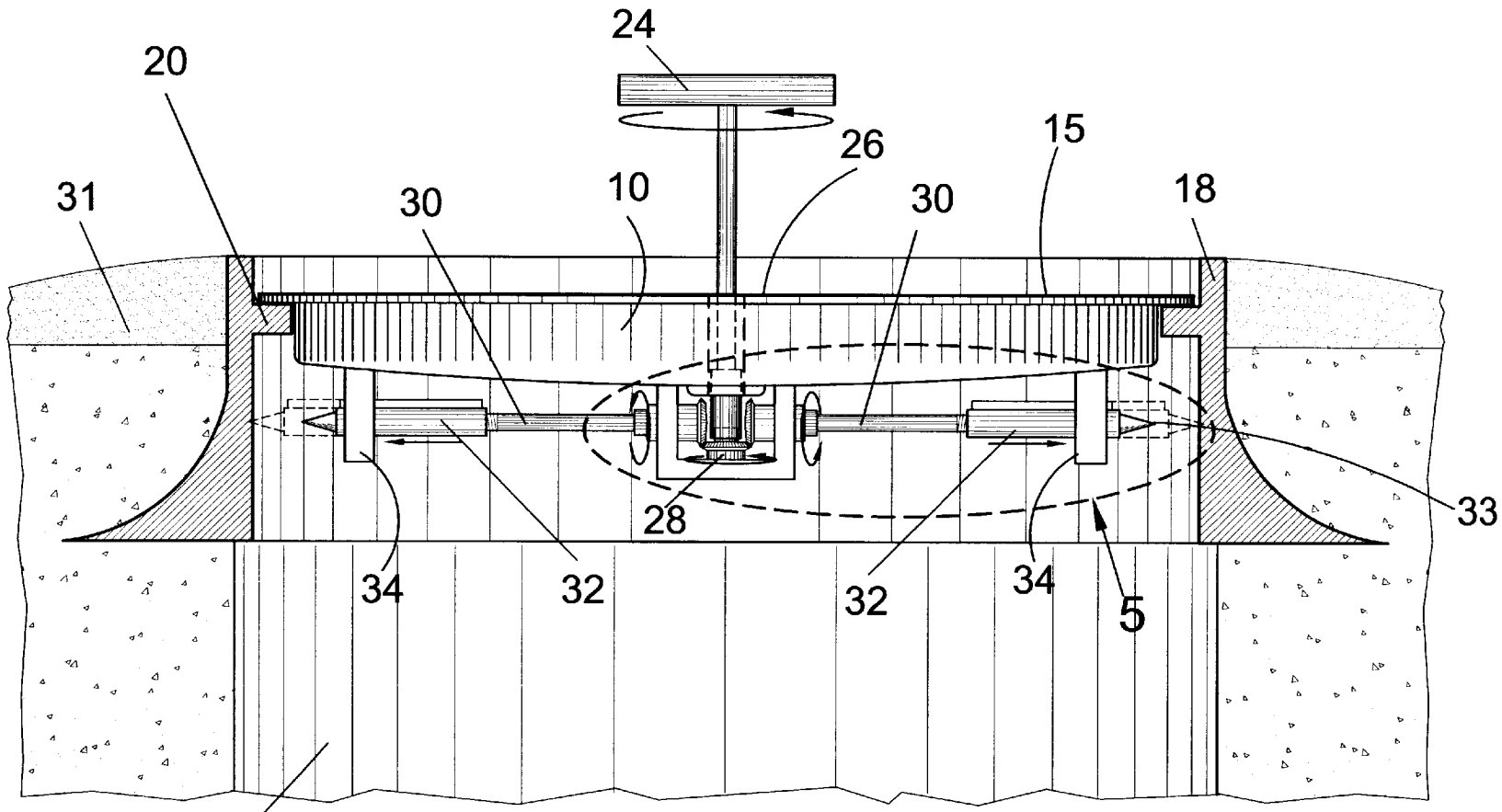
FIG. 3 is a cross-sectional front view of a manhole with the present invention being installed.

Turning to FIG. 3, shown therein is a cross-sectional front view of a manhole tube 22 in the ground 31 with the present invention 10 being installed. The manhole security device 10 mounted on plate-like member 15 has been placed onto the cover retaining flange 20 of the manhole ring 18 and the coded turnkey 24 has been inserted through the turnkey access recess 26 and over the corresponding turnkey interlocking member (See FIGS. 8 and 9 for more details) of the drive gear 28. The interlocking sections of the turnkey 24 and the drive gear 28 cooperate in a manner similar to a conventional socket wrench to turn the drive gear 28 and the interlocking sections are of unconventional configurations to further deter tampering. The drive gear 28 turns two opposing bevel gears and their respective rotatable shafts 30. The distal ends of the rotatable shafts 30 are threaded into non-rotatable, slidable, non-rotatable, locking members 32 that travel through keyway brackets 34 according to the axial rotation of the rotatable shafts 30. During installation the slidable locking members 32 are extended distally until the pointed ends of its tips 33 are imbedded into the soft metal of the manhole ring 18.

Figure 4:
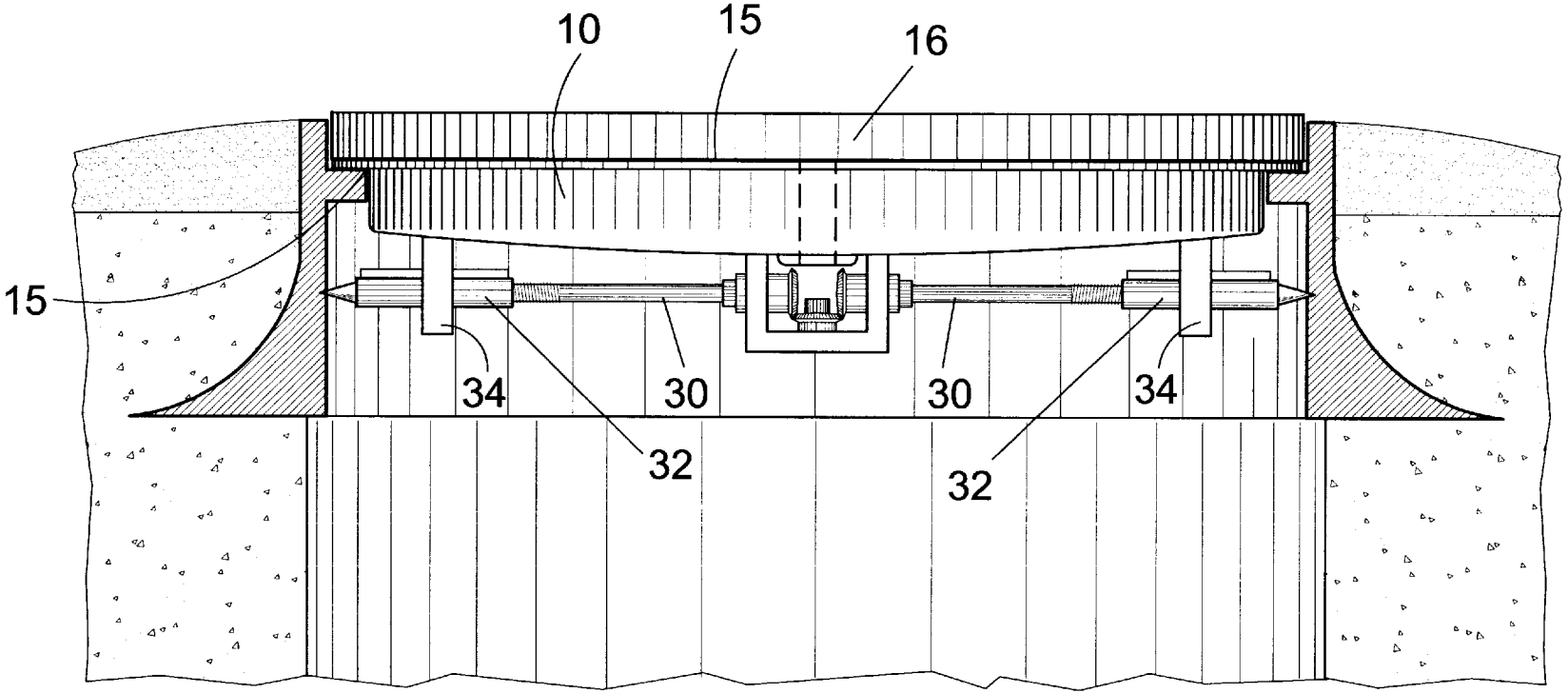
FIG. 4 is a cross-sectional front view of a manhole with the present invention and manhole cover installed.

Turning to FIG. 4, shown therein is a cross-sectional front view of a manhole with the present invention 10 and the manhole cover 16 installed. Also shown are the keyway brackets 34, the rotational shafts 30 and non-rotational sliding locking member 32. Plate 15 is also shown.

Figure 5:
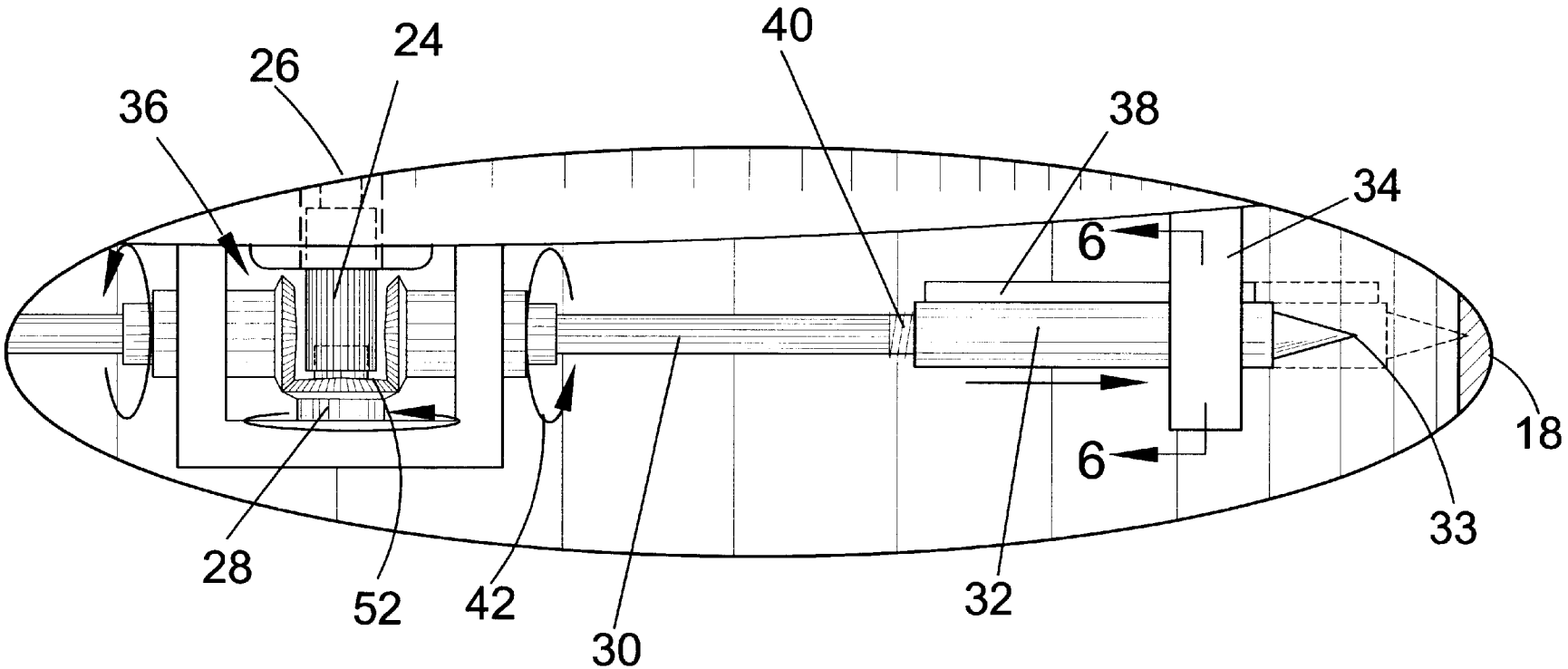
FIG. 5 is a detailed view of the drive gear and locking mechanisms taken from FIG. 3 as indicated.

Turning to FIG. 5, shown therein is a detailed front view of the drive gear and locking mechanism taken from FIG. 3 as indicated. Shown is the coded turnkey 24 inserted through the turnkey access recess 26 and over the mating turnkey interlocking member 46 of the drive gear 28. The interlocking portion of the turnkey 24 and the drive gear 28 being member 46 cooperate in a manner similar to a conventional socket wrench to turn the drive gear 28. The interlocking portions are of unconventional configurations to further deter tampering. The drive gear 28 turns two opposing bevel gears and their respective rotatable shafts 30. The distal ends of the rotatable shafts 30 are threaded into non-rotatable, slidable locking members 32 that travel through keyway brackets 34 as determined by the axial rotation of the rotatable shafts 30. During installation the slidable locking members 32 are extended distally until the pointed ends of its tips 33 are imbedded into the soft metal of the manhole ring 18. Also shown are the double bevel gear assembly 36 which turns shaft 30 having threaded male ends 40 which cooperates with mating female threads in locking member 32. Flange 38 prevents the locking member 32 from turning. Direction arrow 42 is also shown.

Figure 6:
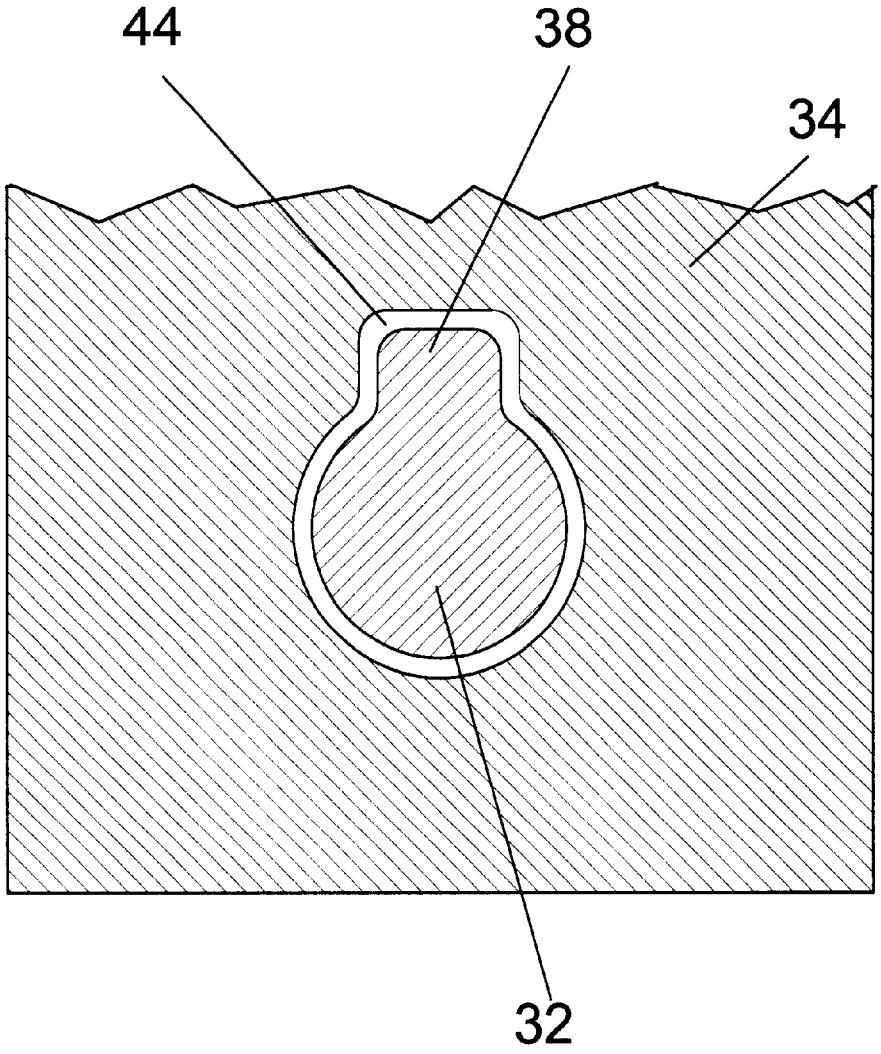
FIG. 6 is a cross-sectional view of the non-rotational, slidable locking member inside the keyway bracket taken from FIG. 5 as indicated.

Turning to FIG. 6, shown therein is a cross-sectional side view of the non-rotational, slidable locking member 32 inside the keyway bracket 34 taken from FIG. 5 as indicated. Shown are the keyway aperture 44 and the anti-rotational flange 38 of locking member 32 which flange prevents the locking member from turning within keyway 44.

Figure 7:
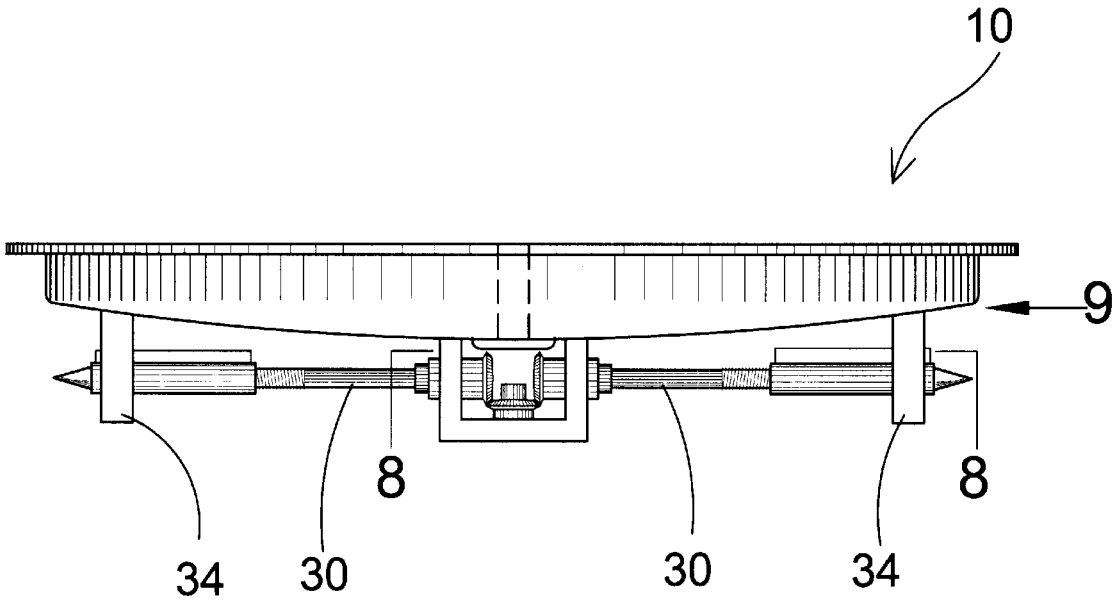
FIG. 7 is a front view of the present invention.

Turning to FIG. 7, shown therein is a front view of the present invention 10. Other elements previously described are also shown.

Figure 8:
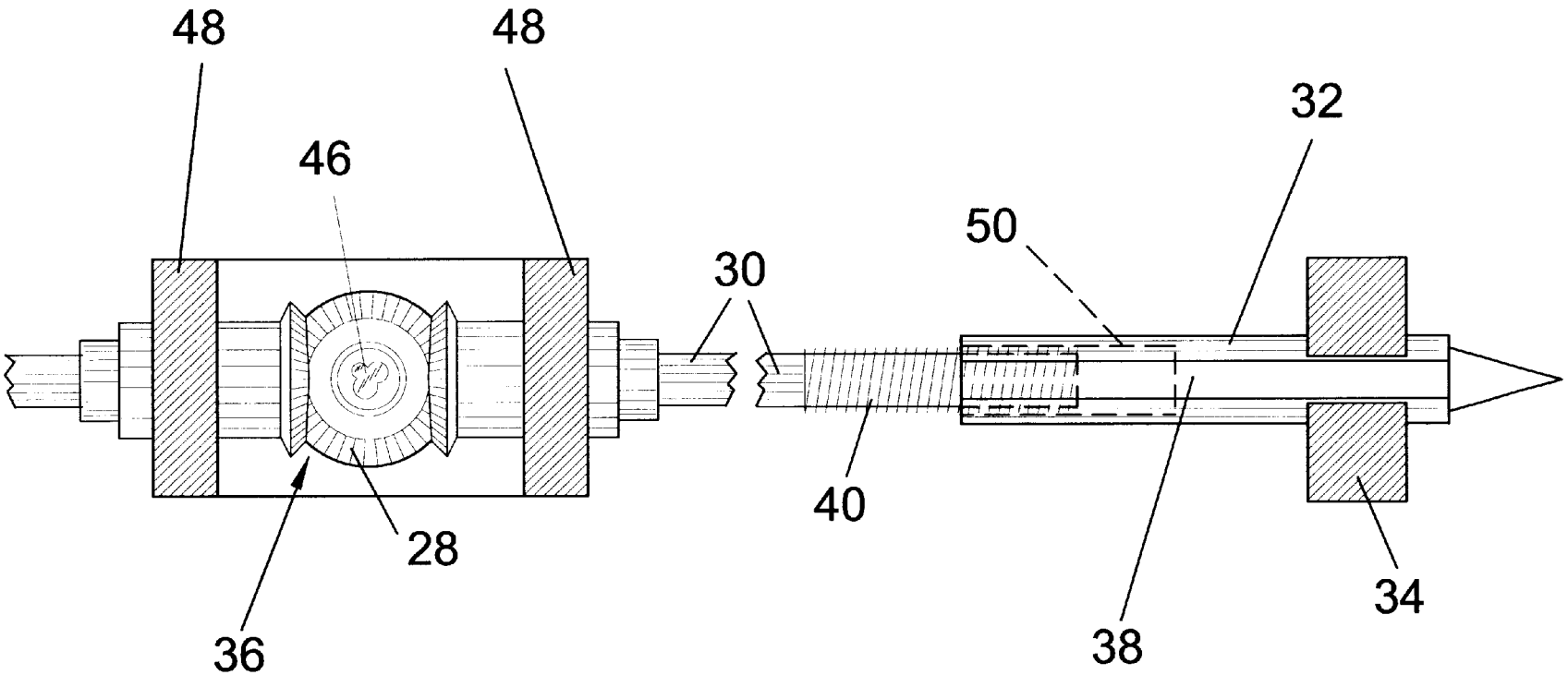
FIG. 8 is a cross-sectional top view of the double bevel gear assembly and related locking mechanism taken from FIG. 8 as indicated.

Turning to FIG. 8, shown therein is a cross-sectional top view of the double bevel gear assembly 36 and related locking mechanism. Shown are the turnkey driven drive gears 28 having a male locking component 46 thereon along with the U-shaped mounting bracket 48. The interlocking sections of the turnkey 24 and the drive gear 28 cooperate in a manner similar to a conventional socket wrench to turn the drive gear 28 and the interlocking sections are of unconventional configurations to further deter tampering. The drive gear 28 turns two opposing bevel gears and their respective rotatable shafts 30. Other elements previously disclosed are shown along with the female threaded portion 50 of the locking member.

Figure 9:
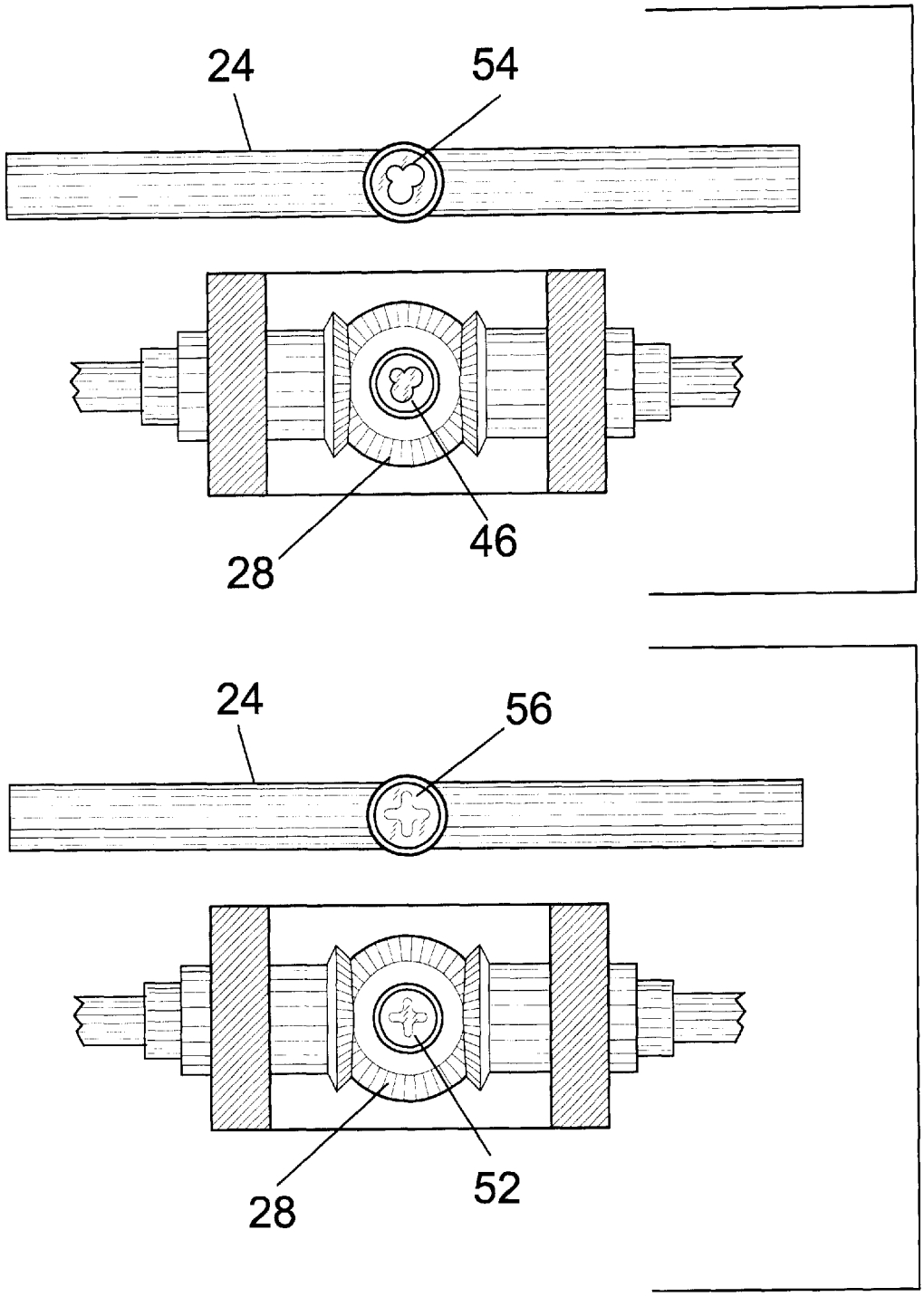
FIG. 9 illustrates two possible configurations of the interlocking components.

Turning to FIG. 9, shown therein are two possible configurations of the male and female interlocking components of the turnkey 24. Shown are the drive gear 28 and the male interlocking member with three lobes 46 and another 52 with four lobes. The three and four lobe female turnkey members 54, 56 are shown, respectively.

What is claimed to be new and desired to be protected by Letters Patent is set forth in the appended claims.

I claim:

1. In an apparatus for a security device for attachment to the entrance into a manhole tube, the manhole tube having a manhole ring with a flange thereon and a manhole cover, the flange having a top surface and a bottom surface, the improvement comprising:

a) a disk member, said disk having a top side and a bottom side, said disk complementarily sized to fit on the top of the flange of the manhole ring, said disk having a centrally located aperture therein;

b) a pair of shafts, said shafts being oppositely disposed shafts disposed on the bottom surface of said disk member, said shafts being generally horizontally disposed, whereby the ends of the shafts contact the manhole ring so as to secure the disk member in the manhole tube, each shaft having a first end and a second end, said first end being rotatable and said second end having a pointed tip, said tip contacting the manhole ring so as to secure said disk member in the manhole tube;

c) means for urging said pair of shafts apart from each other so that said shafts contact the manhole ring so as to secure said disk member in the manhole tube;

d) a turnkey, said turnkey passing through said aperture in said disk to cooperate with said means for urging said shafts apart, said turnkey having a handle end and a interlocking end;

e) said means for urging said shafts apart further comprising a double bevel gear drive assembly disposed so as to cooperate with said turnkey interlocking end so that said shafts are urged apart when the turnkey is turned f) a downwardly extending U-shaped bracket disposed on said bottom surfaces of said disk, said double bevel gear drive assembly being disposed on said U-shaped bracket;

g) said first end of each of said shafts having a bevel gear attached thereto so that said shafts rotate with said bevel gear;

h) said double bevel gear drive assembly further comprising a turnkey driven gear drive;

i) a keyway bracket disposed on said bottom surface of said disk, said keyway bracket having a keyway aperture therein, said aperture for receiving said second end of each of said shafts;

j) said second end of said shafts further comprising a non-rotational slidable locking member disposed thereon, said non-rotational slidable locking member having a means for connection to said second end of each of said shafts whereby said locking members move apart as said shafts rotate, said locking member having a first end and a second end; and k) said means for connection further comprising a set of male threads on said second end of said shafts and a set of mating, female threads on said first end of said non-rotational locking member so that said locking members move apart as said shafts rotate.

2. The apparatus of claim 1, further comprising an anti-rotational flange disposed on said non-rotational locking member whereby said non-rotational locking member is prevented from rotating as said shafts rotate to urge said non-rotational locking members apart.

3. The apparatus of claim 2, wherein said anti-rotational flange further comprises a flange disposed on said non-rotational locking member, said flange cooperating with said keyway aperture so that said locking member slides through said aperture, said locking member being thereby rendered non-rotatable.

4. The apparatus of claim 3, wherein said second end of said non-rotational locking member further comprises a tip, said tip for contacting the manhole ring so as to secure said disk member in the manhole tube.

5. The apparatus of claim 4, wherein said interlocking member end of said turnkey is a female end, said female end having three lobes thereon for mating to said turnkey drive gear.

6. The apparatus of claim 4, wherein said interlocking end of said turnkey is a female end, said female end having four lobes thereon for mating to said turnkey drive gear.

* * * * *